US011737557B2

(12) United States Patent
Clark et al.

(10) Patent No.: US 11,737,557 B2
(45) Date of Patent: Aug. 29, 2023

(54) LIGHTWEIGHT TABLE PROVIDING A PROTECTIVE SHIELD

(71) Applicant: PS FURNITURE, INC., Mequon, WI (US)

(72) Inventors: Roger A. Clark, Milwaukee, WI (US); George Gula, Verona, PA (US)

(73) Assignee: PS FURNITURE, Mequon, WI (US)

( * ) Notice: Subject to any disclaimer, the term of this patent is extended or adjusted under 35 U.S.C. 154(b) by 201 days.

(21) Appl. No.: 17/109,896

(22) Filed: Dec. 2, 2020

(65) Prior Publication Data

US 2022/0167739 A1 Jun. 2, 2022

(51) Int. Cl.

| | |
|---|---|
| ***A47B 37/00*** | (2006.01) |
| ***A47B 41/02*** | (2006.01) |
| *F41H 5/06* | (2006.01) |
| *A47B 13/08* | (2006.01) |

(52) U.S. Cl.

CPC ..... *A47B 37/00* (2013.01); *A47B 41/02* (2013.01); *A47B 13/081* (2013.01); *A47B 2200/0029* (2013.01); *A47B 2200/0036* (2013.01); *F41H 5/06* (2013.01)

(58) Field of Classification Search

CPC ..... A47B 41/02; A47B 13/081; A47B 2200/0029; A47B 2200/0036; A47B 37/00; A47B 87/002; A47B 3/0818; F41H 5/06; F41H 5/18

See application file for complete search history.

(56) References Cited

U.S. PATENT DOCUMENTS

| | | | | |
|---|---|---|---|---|
| 3,342,147 | A * | 9/1967 | Shettles | A47B 87/002 108/64 |
| 6,374,751 | B1 * | 4/2002 | With | A47B 23/002 100/90 |
| 7,698,872 | B2 | 4/2010 | Clark et al. | |
| 8,316,602 | B2 | 11/2012 | Clark et al. | |
| 9,615,658 | B1 | 4/2017 | Nobles et al. | |
| 10,295,311 | B1 | 5/2019 | Trubacek et al. | |
| 2008/0124501 | A1 * | 5/2008 | Clark | F16B 5/0092 428/33 |
| 2011/0000405 | A1 * | 1/2011 | Clark | F16B 5/0092 108/150 |
| 2012/0152096 | A1 * | 6/2012 | Peters | F41H 5/06 89/36.01 |
| 2014/0158024 | A1 * | 6/2014 | Henriott | A47B 3/08 108/27 |
| 2015/0033990 | A1 | 2/2015 | Yeager | |
| 2015/0153143 | A1 | 6/2015 | Hollenbach | |

* cited by examiner

*Primary Examiner* — Matthew W Ing
(74) *Attorney, Agent, or Firm* — Boyle Fredrickson, S.C.

(57) ABSTRACT

A projectile-resistant table provides a reduced weight by employing separate structures for table stiffness and projectile resistance, for example, using a sandwich structure composite with high stiffness and tow projectile resistance for table integrity and a flexible fiber mat with low stiffness but high projectile resistance for shielding.

1 Claim, 5 Drawing Sheets

LIGHTWEIGHT TABLE PROVIDING A PROTECTIVE SHIELD

BACKGROUND OF THE INVENTION

The present invention relates generally to a table providing protection from ballistic materials, and in particular to a table providing such protection in a lightweight design that allows ready deployment and repositioning of the table in emergency situations.

The ability of standard furniture to protect individuals from gunfire and the like can be substantially improved by the incorporation of purpose-designed ballistic shielding into the materials of the furniture. In this regard, it is known to incorporate hard-shell armor plate, ceramic material, or composite laminates into a tabletop which may be then "flipped" into a vertical position to provide a broad protective area and the necessary structural rigidity for a table surface.

A problem with such armored furniture is the ballistic shielding substantially increases the weight of the tabletop and this may require assistive devices such as air springs or dampers to allow individuals to safely and reliably move the table from its normal horizontal position to a protective vertical position. The weight of the ballistic material can also create stability problems when the table surface is moved quickly and can make it difficult to reposition the tables to provide protection in any given situation.

SUMMARY OF THE INVENTION

The present inventors have recognized that using different structures to provide table stiffness and ballistic protection permits the construction of a table that is rigid, protective, and lightweight. In one embodiment, table stiffness is provided by a low mass sandwich structure composite with high stiffness but low projectile resistance while ballistic protection is provided by a relatively flexible mat unsuitable for table support. The ability to use this lightweight ballistic shielding material is possible because table rigidity is obtained by the sandwich structure and an ability to use a lightweight sandwich structure is possible because it does not need to provide ballistic shielding.

Specifically, the invention provides in one embodiment, a projectile-resistant shield in the form of a table having legs supporting a tabletop mounted to the top of the legs to move the tabletop between a horizontal position and a vertical position. The tabletop includes: (a) a load-bearing panel independently providing the tabletop with a substantially rigid upper work surface when the tabletop is in the horizontal position; and (b) a projectile-resistant material attached to the load-bearing panel and independently providing a ballistic rating of at least one of NIJ 0108.01 Armor Type I-IIIA or UL-752 Rating Level 1, 2, 3 & 6 or greater.

It is thus a feature of at least one embodiment of the invention to permit a lighter weight projectile-resistant structure that can be easily deployed and maneuvered by individuals in an emergency situation. A lightweight design is possible by separately optimizing independent table structures for table stiffness versus ballistic protection allowing a lightweight and even flexible ballistic protection material to be used.

The projectile-resistant material may be a fiber composite and/or may be a woven mat of fibers having a thickness of at least 0.1 inches and less than 0.3 inches.

It is thus a feature of at least one embodiment of the invention to permit the use of soft and relatively flexible protective materials combining light weight with reduced spall Mg and risk of ricochet from the ballistic material.

The projectile-resistant material may be attached to an underside of the tabletop when the table is in a horizontal position.

It is thus a feature of at least one embodiment to simply integrate the protective material into the table surface without affecting table strength or function. It is another feature of at least one embodiment of the invention to produce a surface that cosmetically appears to be penetrated by bullets to distract or diverge potential assailants.

The load-bearing panel may provide a sandwich structure composite providing a spacer layer sandwiched between upper and lower high tensile strength sheets of fiber reinforced composites wherein the spacer layer is selected from the group consisting of a honeycombed paper material and an expanded polymer foam.

It is thus a feature of at least one embodiment of the invention to permit the use of a stiff and lightweight construction despite its lack of substantial ballistic protection in itself.

The legs maybe supported directly by the load-bearing panel without a load-bearing beam extending therebetween.

It is thus a feature of the invention to provide a lightweight but stiff table surface that can eliminate the weight of structural steel crossbeams or the like between legs.

The projectile-resistant shield may further include a modesty panel hingeably attached to a front edge of the tabletop to pivot between a position extending perpendicularly downward from the tabletop when the tabletop is in the horizontal position to a position extending parallel and downward from the tabletop when the tabletop is in the vertical position. The modesty panel may include a projectile-resistant material and independently providing a ballistic rating of at least one of NIJ 0108.01 Armor Type I-IIIA or UL-752 Rating Level 1, 2, 6 or greater.

It is thus a feature of at least one embodiment of the invention to provide a modesty panel that provides a desired visual blocking of the waist area of a seated user while providing full height protection when the table is in the vertical position. It is another feature of at least one embodiment of the invention to avoid the need to fix the modesty panel to the table legs where it could interfere with the legs or feet of a seated user during normal table use. The modesty panel may have a height so that it extends to within 2 inches from the floor when the table is in the vertical position.

It is thus a feature of at least one embodiment of the invention to provide a high degree of protection to an individual crouched behind the shield when the tables in the vertical position.

The legs may include pillars having upper ends supporting the tabletop and lower ends attached to transversely projecting leg extensions, and the modesty panel may include cut outs for fitting over the leg extensions when the table is in the vertical position.

It is thus a feature of at least one embodiment of the invention to provide for good table stability through ample leg extensions while offering full height shield protection.

The modesty panel may abut with rearward movement of a front surface of the pillars when the table is in the vertical position.

It is thus a feature of at least one embodiment of the invention to permit the modesty panel to mechanically couple with the remaining weight of the table during shield use.

The modesty panel may extend a full width of the tabletop.

It is thus a feature of at least one embodiment of the invention to provide a full width shield without a need to extend end portions of the modesty panel beyond the legs of the table such as may create a tripping hazard.

The tabletop may attach to the legs with pivot joints allowing pivoting of the tabletop with respect to the legs about a longitudinal axis and a center of mass of the tabletop, and modesty panel may be such as to bias the table to the vertical position. In addition, the table may include a latch mechanism releasably holding the table in the horizontal position against this biasing.

It is thus a feature of at least one embodiment of the invention to provide a table that rapidly deploys to a shield configuration without effort by the user other than to release the latch and without the need for unusual strength by the user to lift a heavy tabletop.

The upper surface of the tabletop may provide a white dry erase marker surface.

It is thus a feature of at least one embodiment of the invention to provide a quick method of distinguishing ballistically augmented tables from standard tables without generating undue concern by students or visitors.

The edges of the table may include releasable latches allowing the table to be interconnected edgewise to other identical tables.

It is thus a feature of at least one embodiment of the invention to provide a system that can be rapidly assembled into multiple table shields for a group of individuals.

The latches maybe magnetic latches.

It is thus a feature of at least one embodiment of the invention to provide a latch system that is unobtrusive during normal table use.

The tabletop and legs may be free from interconnection by viscous dampers.

It is thus a feature of at least one embodiment of the invention to provide a table that can be rapidly deployed without interference by viscous dampers or the like needed to prevent a heavier tabletop from being elevated too quickly.

These particular objects and advantages may apply to only some embodiments falling within the claims and thus do not define the scope of the invention.

DETAILED DESCRIPTION OF THE PREFERRED EMBODIMENT

Figure 1:
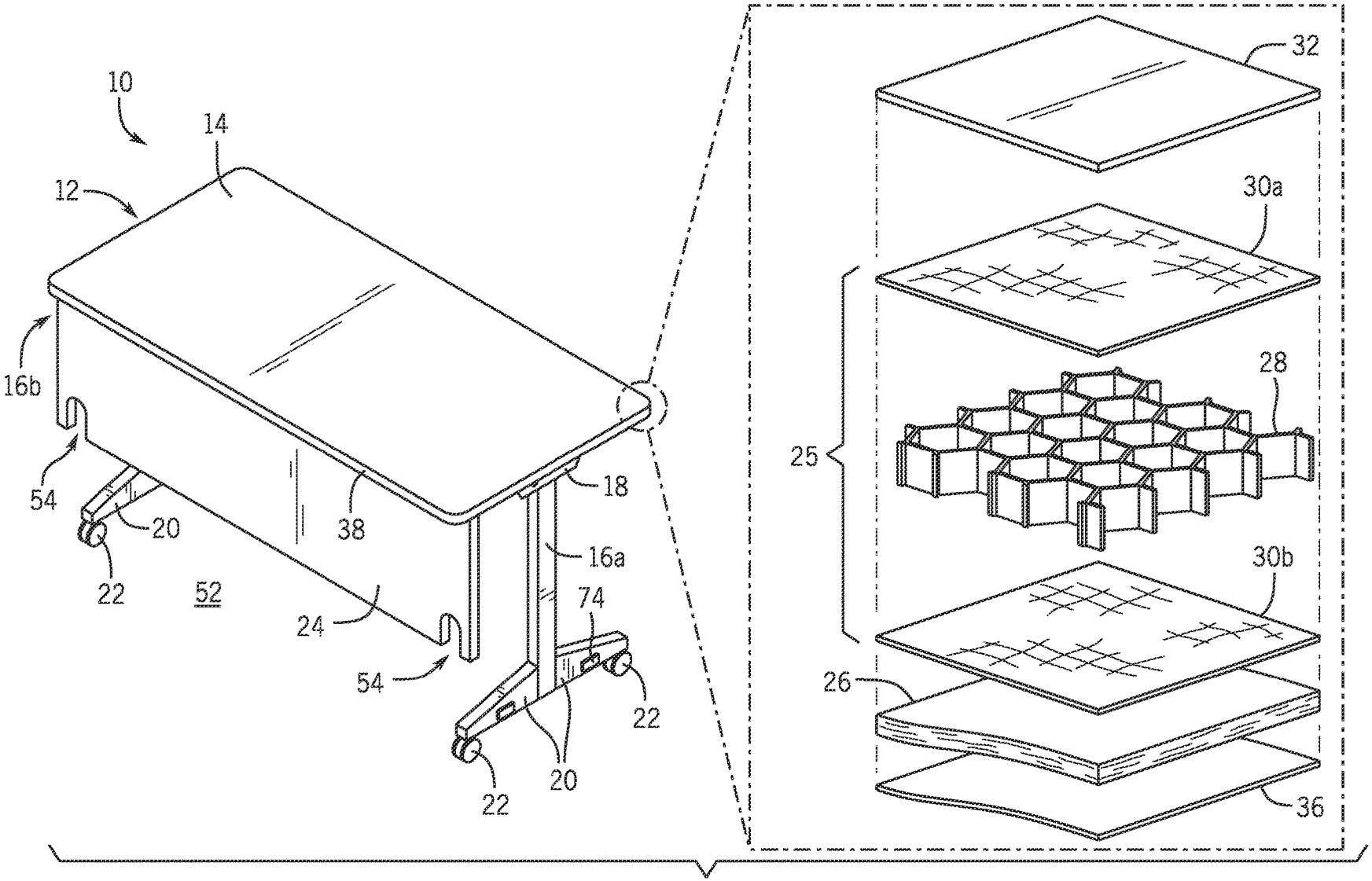
FIG. 1 is a perspective view of a table according to one embodiment of the invention showing an exploded, fragmentary view of the multiple table layers of the tabletop and modesty panel in an inset, and showing the table in a normal horizontal configuration.

Referring now to FIG. 1, a table 10 constructed according to one embodiment of the present invention provides a generally planar and rectangular tabletop 12 having an upper surface 14. In one non-limiting example, the upper surface 14 may present a smooth laminate material which in one embodiment may provide a dry-erase marker surface, the latter being a smooth, white non-absorptive surface for receiving dry marker inks and allowing their removal. In one non-limiting example, the tabletop 12 may be 5 feet long and 24 inches wide and more generally at least 4 feet long and at least 18 inches wide.

The underside of the tabletop 12 may be supported by downwardly extending pillars 16*a* and 16*b* located at opposite longitudinal ends of the tabletop 12 along a centerline extending along the longest dimension of the tabletop 12. The pillars 16 may attach to the tabletop, at their upper ends, by means of brackets 18 attached to the underside of the tabletop 12 as will be described in more detail below. Lower ends of the pillars 16 connect to transversely extending leg extensions 20 together generally equal in length to the transverse length of the tabletop 12. Distal ends of the leg extensions 20 provide downwardly extending lockable roller casters 22.

The pillars 16, brackets 18, legs 20, and casters 22 together may elevate the upper surface 14 of the tabletop 12 to a standard height of between 26 and 32 inches allowing comfortable used by a seated individual.

A modesty panel 24 may be attached at one edge to an underside of the tabletop 12 by means of a hinge, for example, a piano hinge 27 (shown in FIG. 3), to extend longitudinally along the underside of the tabletop 12 along its frontmost edge away from the side of a seated. individual and thus removed from interference with this individual's legs or feet.

Referring still to FIG. 1, the tabletop 12 may provide laminated, interconnected layers of materials including upper table stiffness layers 25 and a lower ballistic layer 26. The upper table stiffness layers 25 in one embodiment provide a sandwich structure composite exhibiting high stiffness and extremely light weight. This sandwich structure composite includes a central spacer layer 28, for example, constructed of a lightweight material such as honeycomb cardboard or foam that provides moderate compressive and tensile strength along a vertical axis (as oriented in FIG. 1) and serves to space apart upper and lower tensile layers 30*a* and 30 in fixed parallel spaced opposition. The tensile layers 30 may be, for example, a fiber composite material having horizontally running fibers such as fiberglass captured in a polymer resin matrix such as a polyurethane. In one embodiment, the thickness of the spacer layer 28 may be one-half inch or greater. These tensile layers 30*a* and 30*b* provide high tensile strength along a horizontal plane and when adhered to the upper and lower surfaces of the central spacer layer 28 provide a truss-like structure with extremely high stiffness and low weight. A truss structure provides high stiffness by transforming deforming bending loads into tensile forces along the layers 30.

Construction of this sandwich structure composite follows the teachings of U.S. Pat. Nos. 8,316,602 and/or 7,698,872 assigned to the assignee of the present invention and hereby incorporated by reference. These construction techniques may include infusing a fiber mat forming the tensile layers 30 with an adhesive matrix material that simultaneously connects the mats of the tensile layers 30 to the spacer layer 28.

The upper tensile layer 30*a* may be covered with a working surface 32 such as a laminate material, such as a melamine resin composite, and as noted, in a preferred embodiment, may provide a dry erase or whiteboard type surface of painted steel, painted aluminum, laminate or the like. This upper working surface 32 may be attached to the upper tensile layer 30*a* with an adhesive such as a contact cement or by using the matrix material of the tensile layers 30 in a single step process with the assembly of the tensile layers 30 to the spacer layer 28.

Adhered to a lower surface of the lower tensile layer 30*b* is the ballistic layer 26 independently providing a ballistic protection function without significant contribution to table stiffness. The ballistic layer 26 may, for example, be a semi-flexible mat of multiple layers of woven or nonwoven fibers such as fiberglass or arimids adhered in multiple points of cross connection with a thin matrix polymer coating such as polyurethane. The fibers be may, for example, aramid fibers such as those produced under the trade name of Kevlar® by the DuPont Company of Wilmington, Del., United States, or glass fibers or the like. Generally the fibers will have substantial tensile strength in the horizontal plane but will have a high degree of flexibility making it unsuitable alone for providing stiffness to the tabletop 12, the latter which must resist, for example, bowing between the supports of the table pillars 16 or warpage, In one embodiment, the ballistic layer 26 is Amulet® 1 Ballistic Barrier material having a thickness of approximately 0.02 inches and an average weight of 1.3 pounds per square foot commercially available from Ballistic Furniture Systems, Inc. of Scottsdale, Ariz., USA. This material meets or exceeds the standards of NIJ 0108.01 Armor Type I-IIIA or UL-752 Rating Level 1, 2, 3 & 6 providing protection, for example, that will resist a 240 grain bullet from a 44 Magnum traveling at 1400 ft./s.

The ballistic layer 26 may be adhered to the lower tensile layer 30*b* with a pressure sensitive adhesive or using the polymer matrix material used to form the composite of the tensile layer 30. More generally, this ballistic layer 26 may be a woven mat having a thickness of greater than 0.1 inches and typically greater than 0.2 inches.

The underside of the ballistic layer 26 may be covered with a backer layer 36 providing a smooth and finished lower surface, for example, a coated paper or film type material. The various layers 32, 30*a*, 28, 30*b*, 26, and 36 may fit within a peripheral frame (not shown) which may be in turn surrounded by an extruded vinyl bumper 38 or the like as is generally understood in the art attached, for example, by a rabbet in the peripheral frame receiving a barbed projection from a rear side of the extruded vinyl bumper 38 or the like.

Figure 2:
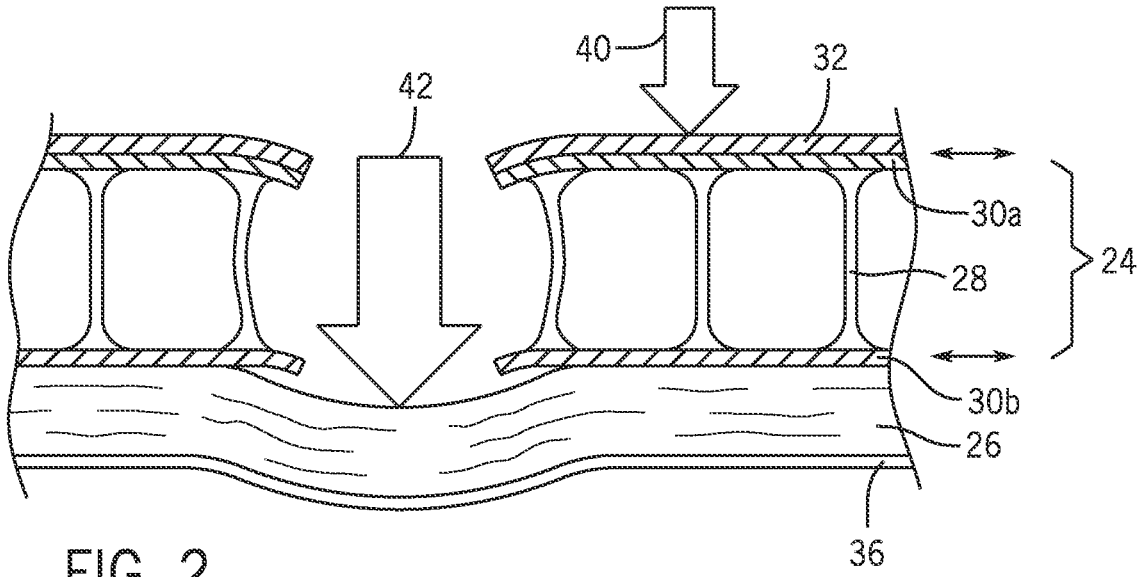
FIG. 2 is an elevational cross-section through the layers of FIG. 1 as assembled showing the distinct elements of a lightweight sandwich structure for table stiffness and a conformal fabric ballistic shield for projectile protection.

Referring now to FIG. 2, it will be appreciated that the stiffness layers 25 may operate independently of the ballistic layer 26 to provide stiffness against bowing or distortion of the tabletop 12 under normal table operating forces 40, for example, an individual resting books or writing materials on the top of the table in normal use. High impact forces 42, for example, resulting from impact by a projectile, cause a penetration of the upper table stiffness layers 25 so that the projectile strikes the ballistic layer 26. The ballistic layer 26 exhibits high inherent. flexibility that prevents spoiling (high velocity chipping of a harder surface that might create shrapnel) and suppresses projectile ricocheting while essentially "netting" and enveloping the projectile as its energy is dissipated in ply delamination and a tearing of the ballistic layer 26 from the tensile layer 30*b*. The high tensile strength of the materials of the ballistic layer 26 spread the projectile impact force to neighboring surfaces.

The destruction of the stiffness layers 25 is believed to create an impression of a conventional bullet hole in a non-resistive table such as may mollify an attacker.

The modesty panel 24 may have identical construction to the tabletop 12 but for the working surface 32 (the front surface of the modesty panel 24) which may be the same or a different laminate from the working surface 32 of the tabletop 12.

Figure 3:
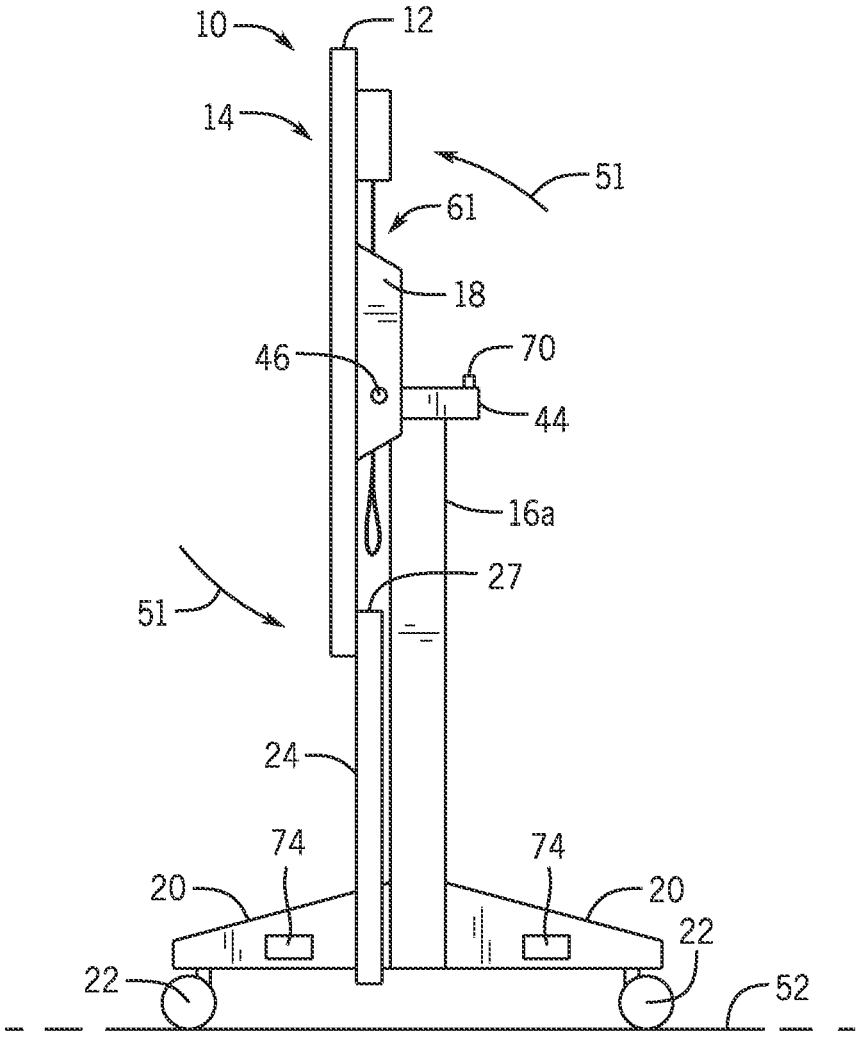
FIG. 3 is a right side elevational view of the table of FIG. 1 in a protective vertical configuration showing a hinging downward of the modesty panel to provide a continuous blocking surface.

Referring now to FIG. 3, the upper ends of the pillars 16 may provide a capital plate 44 attached to the bracket 18 by a pivot axle 46. The pivot axle 46 defines a transverse axis about which the tabletop 12 may pivot with respect to the pillars 16 as indicated by arrows 51. In this pivoting, the front edge of the tabletop 12 moves downwardly and the modesty panel 24 hinges with respect to the tabletop 12 to maintain a vertical orientation but to extend downwardly now parallel to the upper surface 14 of the table 10. In this pivoting process, a lowermost edge of the modesty panel 24 closely approaches the floor 52 so that the upper surface 14 of the table in front surface of the modesty panel 24 provides a substantially continuous shielding surface from the floor to the upper edge of the table surface 14, for example, to a height generally greater than 4 feet from the floor 52.

Figure 4:
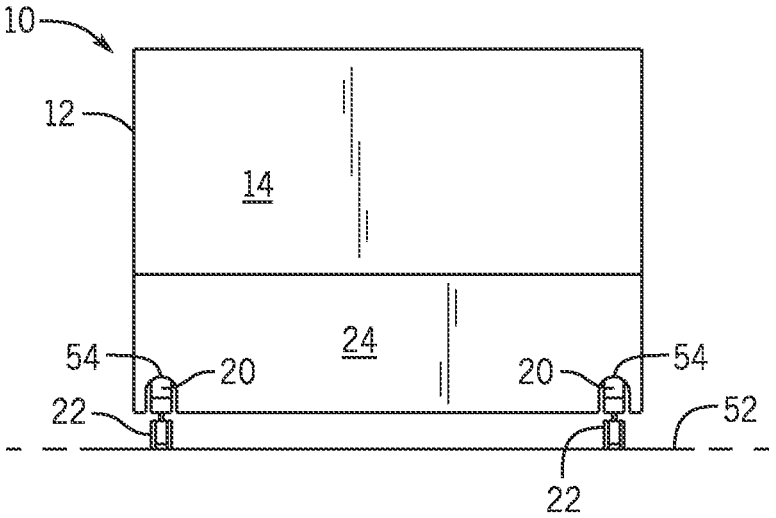
FIGS. 4 and 5 are front elevational views of the table of FIG. 3 in the vertical position showing two versions of the modesty panel providing leg cutouts that allow the modesty panel to be supported by the upward extent of the legs.
Figure 5:
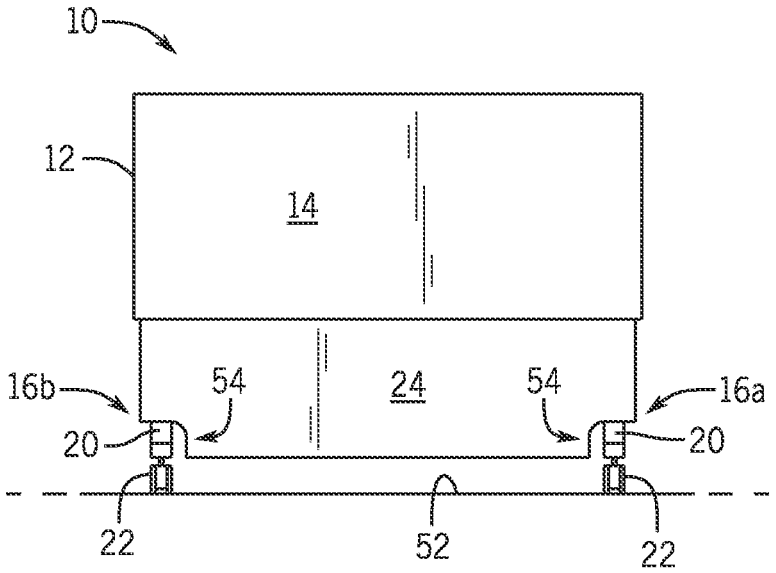

Referring now to also to FIG. 4, in one embodiment the modesty panel 24 may extend the full transverse length of the tabletop 12. In this case, cutouts 54 (also shown in FIG. 1) may be provided so that the lower edge of the modesty panel 24 may fit over the legs 20 and thus more closely approach the floor 52 than would otherwise be possible. It will be noted that the rear surface of the modesty panel 24 may thus be supported against rearward further motion by the front surface of the upwardly standing pillars 16 in furtherance of it shield function.

Alternatively, referring to FIGS. 3 and 4, the modesty panel 24 may extend only by a distance of separation of outermost edges of the pillars 16 so that partial cutouts 54 may be employed.

Figure 8:
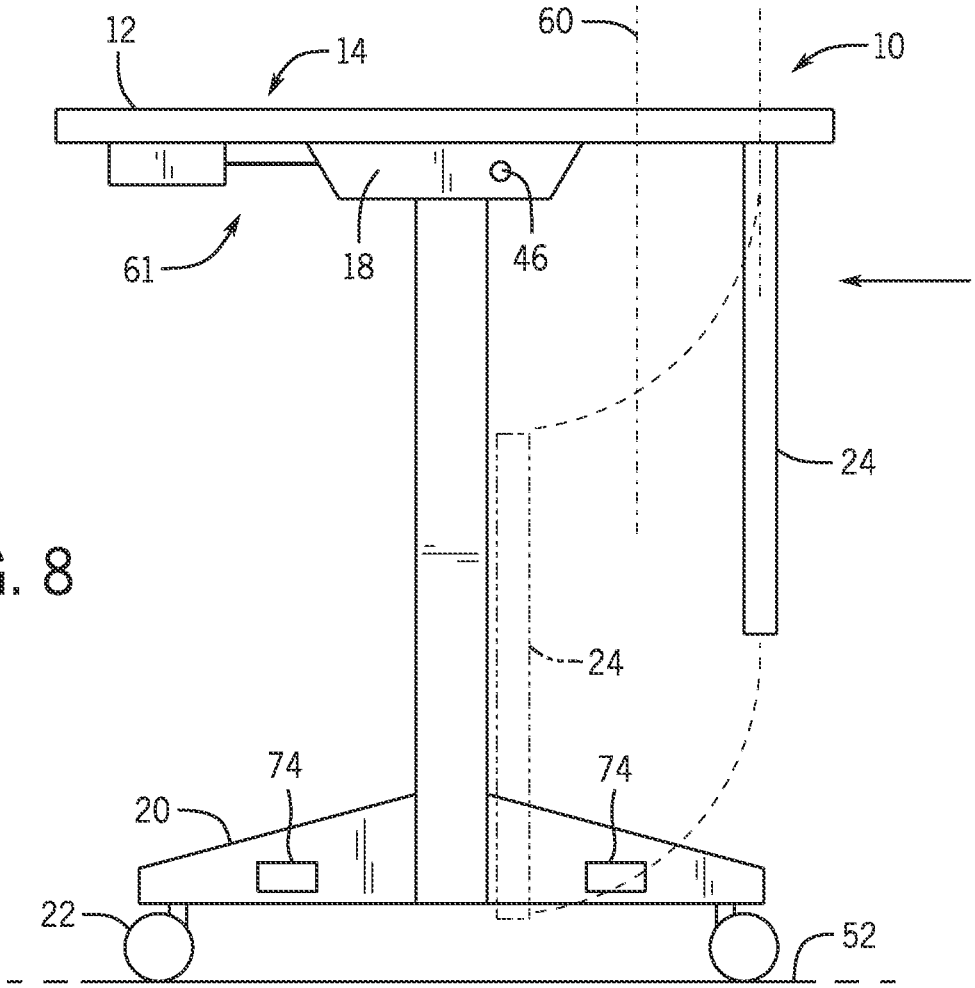
FIG. 8 is a left side elevational view similar to FIG. 3 showing the protective elements of the modesty panel when the table is in its normal horizontal position and an offset of the center of gravity which promotes movement of the table to the vertical position.

Referring now to FIG. 8, it will be appreciated that in a normal horizontal position of the upper surface 14 of the table 10, the modesty panel 24 provides not only the desired function of blocking a view of the lower torso of a seated individual but also basic projectile resistance for an individual crouched behind the table allowing critical areas that person's head to be protected. from projectiles and shrapnel.

The positioning of the modesty panel 24 or a placement of the tabletop 12 with respect to the pivot axis 46 moves the center of gravity 60 of the tabletop 12 forward with respect to the pivot axis 46 so that the tabletop 12 when unlatched (as will be described) will naturally swing to a vertical orientation shown in FIG. 3 without requiring substantial physical strength or capability by the user. The modesty panel 24 naturally pivots downward into its position close to the floor 52 to provide a continuous shield with the upper surface 14 of the table. Generally, the height of the modesty panel 24 will be such as to bring the modesty panel to a position to within 3 inches and preferably within 2 inches and desirably within 1 inch of the floor 52. In particular, lower edge of the modesty panel 24 may drop below the lower surface of the outwardly extending legs 20. This latter close clearance is possible without interference between the modesty panel 24 and items on the floor 52 during normal use, tor example, a rolling of the table 10, by the fact that the modesty panel 24 elevates when the table 10 is in the normal horizontal position, That height of the modesty panel may be at least 10 inches and desirably at least 18 inches.

Figure 6:
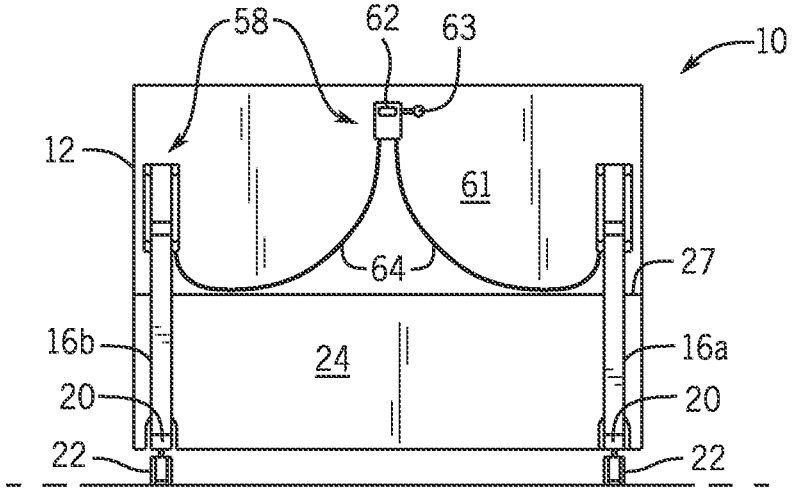
FIG. 6 is a rear view of the table of FIGS. 3 and 4 showing a latch mechanism underneath the table communicating between a handle under the rear surface of the table and leg brackets that can be released to allow the table to move to the vertical protective position.
Figure 7:
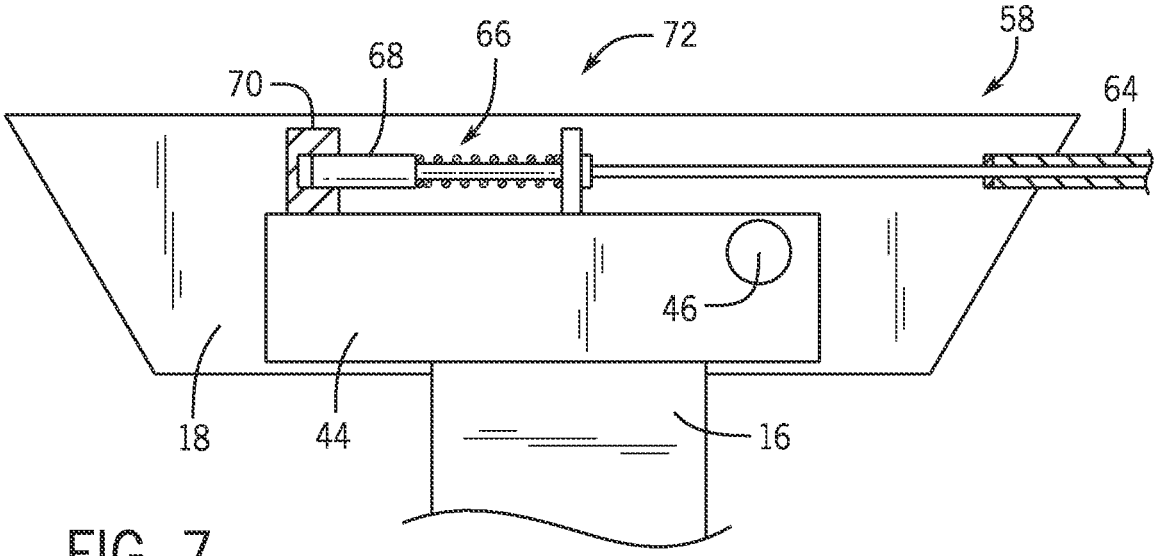
FIG. 7 is a phantom view of the leg bracket showing an internal mechanism of the latch.

Referring now to FIGS. 6 and 7, a normal gravitational biasing of the tabletop 12 to the protective position is resisted by means of a latch mechanism 58 having a slide handle 62 attached to the undersurface 61 of the tabletop 12 near its rear edge to be convenient to a seated user. The slide handle 62 may be gripped by a user by reaching under the rear edge of the tabletop 12 (away from the modesty panel 24) and pulling back on a slide handle 62 and is attached by means of Bowden cables 64 to latch mechanisms 66 contained in each bracket 18. These latch mechanisms 66 may provide a spring-biased plunger 68 that normally engages an upwardly extending tooth 70 on the capital plate 44. A pulling back on the slide handle 62 by the Bowden cables pulls the spring biased plunger 68 away from engagement with the tooth 70 allowing the tabletop 12 to pivot to its vertical upward position. An optional pin 63 may be provided that needs to be removed before actuation of the handle 62 to prevent inadvertent unlatching of the table. In addition, it will be appreciated that a latching may be provided when the table is in the vertical position as well.

Figure 9:
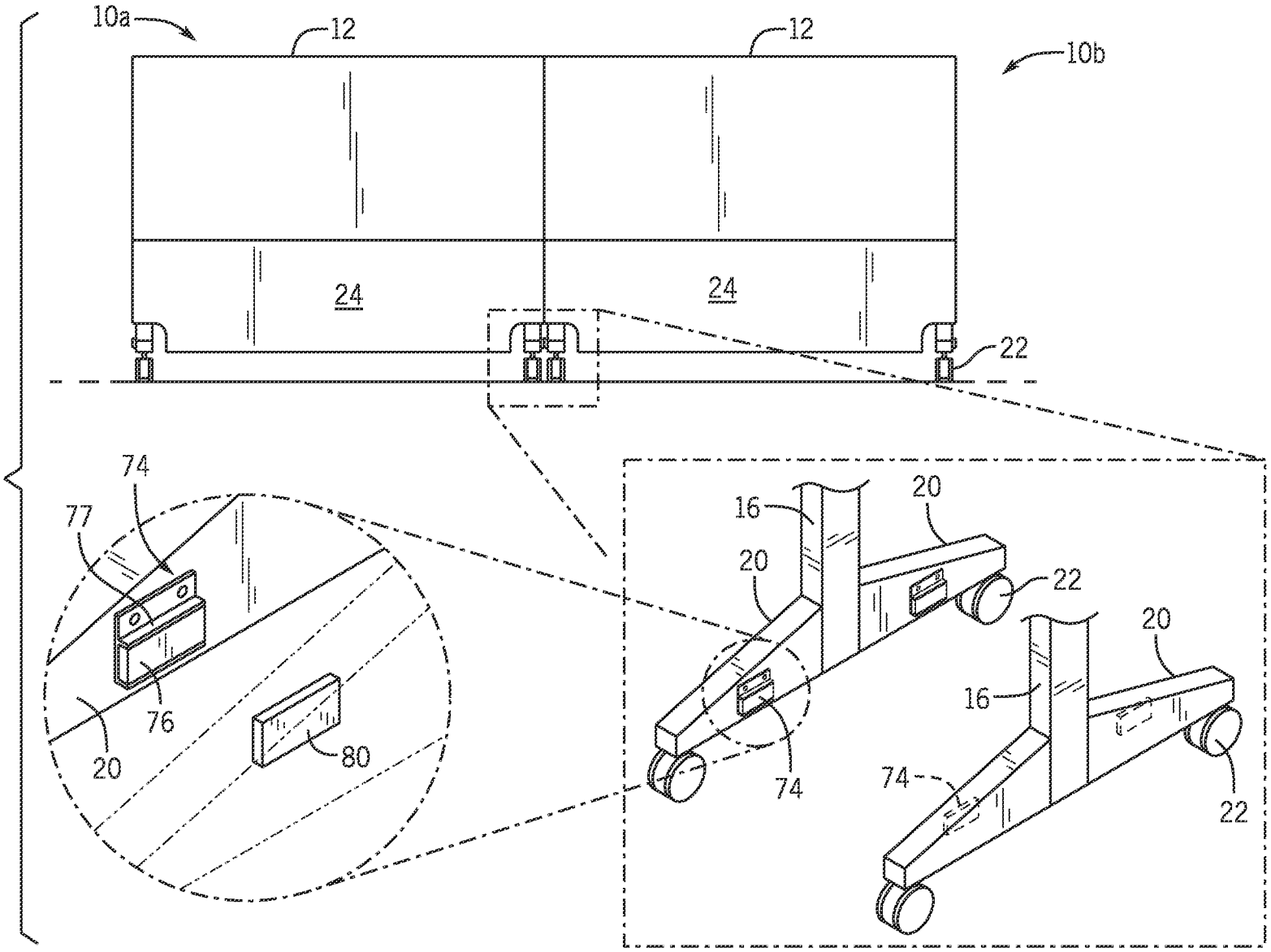
FIG. 9 is a simplified diagram of two tables assembled together using magnetic fastening

Referring now to FIG. 9, the outer surfaces of the leg extensions 20 of tables 10 may include latch mechanisms 74 so that, for example, a first table 10*a* in the vertical position may be overlapped over a second table 10*b* and attached to the second table 10*b* to be retained there against to provide for a substantially longer shield that provides continuous protection. These latch mechanisms 72 allow the assembling of an arbitrary number of tables 10 in a line forming a longitudinally extended continuous shield and may accommodate a slight inset of the ballistic material 26 from the edge of the table top.

In one embodiment the latch mechanism 72 may include a set of magnetic catches formed by magnets 76 and slidable keepers 77, in the manner of a cabinet latch, positioned in the right most edge of each tabletop 12 and corresponding ferromagnetic attractor plates 80 in the leftmost edges of each tabletop 12. The magnetic attraction provides a simple method of interconnecting the tables that can resist projectile forces as moderated by the mass of the table 10 itself. The latch mechanism 72 may be fit within the aluminum structure of the legs or may project there from. Other latch mechanisms are also contemplated including those that employ mechanical hooks and the like including but not limited to the attachment system described in U.S. Pat. No. 8,316,602 cited above.

Generally, the construction of the pillars 16, brackets 18, and legs 20 may be of welded steel or aluminum to provide good strength and to support the protective surfaces of the table during impact. The brackets 18 may be attached directly to the material of the lower tensile layer 30 B, for example, with screws or the like and without an interconnecting I-beam between the pillars 16, relying instead on the stiffness of the tabletop 12 to provide a stable and non-warping working surface. In one embodiment, the ballistic layer 26 may provide an added weight of 1.3 pounds per square foot to the weight of the stiffness layers 25 of approximately 2 pounds per square foot providing an areal weight of the table surface 14 of less than 4 pounds per square foot (approximately 33 pounds in a 5'×2' table surface). This should be compared to weights of up to 15 pounds per square foot using hard-shell armor. As a result of the light weight of the table 10, air springs and assistive lifting devices and dampers that provide speed sensitive resistance to motion and/or spring biasing to make the lifting and control of an extremely heavy shielding surface are not required.

It will be appreciated that the protective capability of the table 10 may be increased by increasing the ballistic layer 26, for example, using Amulet® 3 from the supplier described above which provides a rating of NIJ 0108.01 Armor Type OR A UL-752 Rating Level 1-8 with a thickness of approximately 0.9 inches and an added weight of 4.2 pounds per square foot. This compares to a weight of approximately 15 pounds per square foot for fiberglass of comparable ballistic quality or 10 pounds per square foot for quarter inch steel plate.

Certain terminology is used herein for purposes of reference only, and thus is not intended to be limiting, For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(t) unless the words "means for" or "step for" are explicitly used in the particular claim.

What we claim is:

1. A projectile-resistant shield comprising:

a table having legs supporting a tabletop mounted to the top of the legs to move the tabletop between a horizontal position and a vertical position;

wherein the tabletop includes:

(a) a toad-bearing panel independently providing the tabletop with a substantially rigid upper work surface when the tabletop is in the horizontal position; and (b) a projectile-resistant material attached to the load-bearing panel and independently providing a ballistic rating per standards of at least one of NIJ 0108.01 Armor Type I-IIIA or UL-752 Rating Level 1, 2, 3 & 6, or greater, according to a version of at least one of the standards as of the date of filing of this application; and wherein the load-bearing panel provides a sandwich structure composite providing a spacer layer sandwiched between upper and lower high tensile strength sheets of fiber reinforced composites wherein the spacer layer is selected from the group consisting of a honeycombed paper material and an expanded polymer foam, wherein the legs are supported directly by the load-bearing panel without a structural crossbeam extending therebetween.

* * * * *